US007267705B2

(12) United States Patent
Choi et al.

(10) Patent No.: US 7,267,705 B2
(45) Date of Patent: Sep. 11, 2007

(54) LOCKING UNIT OF CYCLONE TYPE DUST COLLECTING APPARATUS

(75) Inventors: Min-jo Choi, Gwangju (KR); Byung-jo Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 613 days.

(21) Appl. No.: 10/753,380

(22) Filed: Jan. 9, 2004

(65) Prior Publication Data

US 2004/0261216 A1 Dec. 30, 2004

(30) Foreign Application Priority Data

Jun. 26, 2003 (KR) ..... 10-2003-0042054

(51) Int. Cl.
*B01D 45/12* (2006.01)

(52) U.S. Cl. ..... 55/429; 55/459.1; 55/DIG. 3

(58) Field of Classification Search ..... 55/429, 55/459.1, DIG. 3; 15/352, 353
See application file for complete search history.

(56) References Cited

U.S. PATENT DOCUMENTS

2004/0123416 A1* 7/2004 Lee ..... 15/352

FOREIGN PATENT DOCUMENTS

GB 2396800 A 7/2004

OTHER PUBLICATIONS

Combined Search and Examination Report (issued Sep. 22, 2004) issued from the Great Britain Patent Office for British Patent Application No.: GB0409484.3.

* cited by examiner

*Primary Examiner*—Robert Hopkins
(74) *Attorney, Agent, or Firm*—Blank Rome LLP

(57) ABSTRACT

Disclosed is a locking unit to fix a removable cyclone dust collector in a receiving portion of a main body of a vacuum cleaner. The locking unit comprises a locking recess formed at one side of a contact surface of the cyclone dust collector and the receiving portion. A lock element ascends and descends between a locking position and an unlocking position with respect to the locking recess and passes through a hole which is formed at another side of the contact surface of the cyclone dust collector and the receiving portion. An operating member selectively moves the lock element to the locking position and the unlocking position.

8 Claims, 8 Drawing Sheets

LOCKING UNIT OF CYCLONE TYPE DUST COLLECTING APPARATUS

REFERENCE TO RELATED APPLICATION

This application claims priority to copending Korean Patent Application No. 10-2003-0042054, filed Jun. 26, 2003, which is entirely incorporated herein by reference.

FIELD OF THE INVENTION

The present invention relates to a vacuum cleaner with a cyclone type dust collecting apparatus, and more specifically, to a locking unit to removably fix a cyclone type dust collecting apparatus to an upright type vacuum cleaner.

BACKGROUND

Referring to FIG. 3, an upright type vacuum cleaner comprises a main body 20 with a suction brush unit 10 mounted therein, and a cyclone type dust collecting apparatus 30 received in a receiving portion 21 of the main body 20 of the vacuum cleaner. The cyclone type dust collecting apparatus 30 centrifugally separates dust and dirt from air, which is a technology well known in the related art. The cyclone type dust collecting apparatus 30 is fixed in the receiving portion 21 using a locking unit.

FIG. 1 is a cross sectional view of the cyclone type dust collecting apparatus 30 fixed in the receiving portion 21 by a conventional locking unit 100. FIG. 2 is an exploded perspective view of a main portion of the conventional locking unit of FIG. 1. Referring to FIGS. 1 and 2, the conventional locking unit 100 includes a supporting bracket 101 disposed on a bottom plate 45 of the receiving portion 21 (see FIG. 3), a movable disk 111 rotatably disposed in the supporting bracket 101, and a locking disk 121 disposed at an upper portion of the movable disk 111 to move upward and downward.

A hinge axis 112 is formed at a center portion of the movable disk 111, and at a center of the hinge axis 112 an axis hole 113 is formed. The axis hole 13 of the movable disk 111 is rotatably connected with an axis 102 which protrudes at a center of the region surrounded by the supporting bracket 101. The hinge axis 112 of the movable disk 111 is rotatably connected with a hinge hole 123 at a center of the locking disk 121. On a top side of the movable disk 111, a cam 115 is formed along a circumference of the movable disk 111 at a predetermined inclination.

Also, on a bottom side of the locking disk 121 a cam 125 is formed along a circumference of the locking disk 121 at a predetermined inclination. Accordingly, upon rotating the movable disk 111 in a clockwise or counter clockwise direction, the locking disk 121 is moved upward and downward by the cooperation of the cam 115 of the movable disk 111 and the cam 125 of the locking disk 121. At an outer surface of the movable disk 111 an operating lever 118 is formed extending in a radial direction of the movable disk 111 for a user to rotate the movable disk 111 in the clockwise or counter clockwise direction.

At a bottom side of the cyclone type dust collecting apparatus 30, a receiving recess 133 is depressed inwardly for receiving the locking unit 100. At an inner wall of the receiving recess 133 a fixing recess 135 is formed to engage with the locking disk 121. For instance, upon rotating the movable disk 111 in the clockwise direction by moving the operating lever 118, the locking disk 121 is ascended. The locking disk 121 ascends into the fixing recess 135 of the cyclone type dust collecting apparatus 131, and by engaging the fixing recess 135 and the movable disk 111, the cyclone type dust collecting apparatus 131 is fixed.

However, the locking unit 100 of the conventional cyclone type dust collecting apparatus 30 described above has a complicated structure and a bulky size. Also, it is difficult to manufacture and assemble the locking unit 100, since the receiving recess 133 and the fixing recess 135 are respectively formed at the bottom side of the cyclone type dust collecting apparatus 30, to thereby increase the manufacturing cost. In addition, separating the cyclone type dust collecting apparatus 30 from the receiving portion 21 is complicated. Especially, the bulky locking unit 100 is exposed outside to thereby depreciate an appearance of the vacuum cleaner.

From the user's viewpoint, it is difficult to manipulate the locking unit 100 with one hand by moving the operating lever 118 in the horizontal direction with respect to the vacuum cleaner.

SUMMARY OF THE INVENTION

In view of the above shortcomings, an aspect of the present invention is to provide a locking unit of a cyclone dust collector having a simple structure, which enables easy and convenient manufacturing and assembling to thereby reduce the manufacturing cost.

Another aspect of the present invention is to provide a locking unit of a cyclone dust collector which enhances an appearance of a vacuum cleaner.

Yet another aspect of the present invention is to provide a locking unit by which a cyclone dust collector is fixed with a simple operation.

To accomplish the above aspects and features of the present invention, a locking unit of a cyclone dust collector of a vacuum cleaner, which is removably received in a receiving portion of a main body of the vacuum cleaner, includes a locking recess formed at one side of a contact surface of the cyclone dust collector and the receiving portion, a lock element ascending and descending between a locking position and an unlocking position with respect to the locking recess and passes through a hole which is formed at the other side of the contact surface of the cyclone dust collector and the receiving portion, and an operating member to selectively move the lock element to the locking position and the unlocking position.

The locking recess is formed by depressing upwardly at a bottom side of the cyclone dust collector, and the lock element is received in a manipulating unit disposed at a lower portion of the receiving portion to move upward and downward through the hole at a bottom side of the receiving portion.

The operating member includes a grip rotatably exposed toward a front side of the manipulating unit, an extended bar extending from the grip toward the lock element passing through the front side of the manipulating unit, and an operating cam formed on a free end of the extended bar eccentrically. The operating cam rotates together with the grip and moves the lock element upward and downward.

At the front side of the manipulating unit an indicator is disposed to indicate locking and unlocking of the lock element with respect to the locking recess.

According to the structure mentioned above, the locking unit of the cyclone dust collector may have a simple structure enabling easy manufacture and assembly, and a reduced manufacturing cost. In particular, using the locking unit, the cyclone dust collector operates easily. Also, while the cyclone dust collector is separated, there is no distraction from the appearance of the vacuum cleaner.

BRIEF DESCRIPTION OF THE DRAWINGS

The above aspects, and other features and advantages of the present invention will become more apparent after a reading of the following detailed description when taken in conjunction with the drawings, in which.

DETAILED DESCRIPTION OF THE PREFERRED EMBODIMENT

Hereinafter, a preferred embodiment of the present invention will be described in greater detail, with reference to the accompanying drawings.

Figure 1:
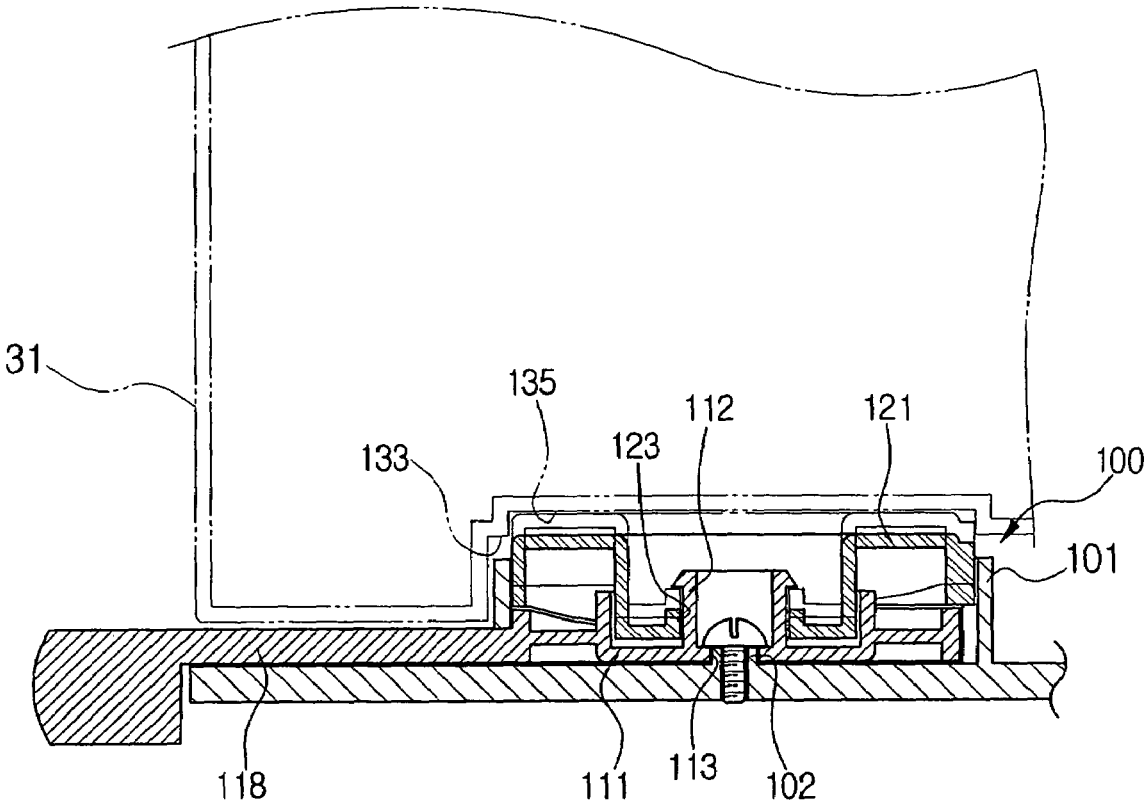
FIG. 1 (PRIOR ART)
FIG. 1 is a cross sectional view of a conventional locking unit for a cyclone type dust collecting apparatus of an upright type vacuum cleaner.
Figure 2:
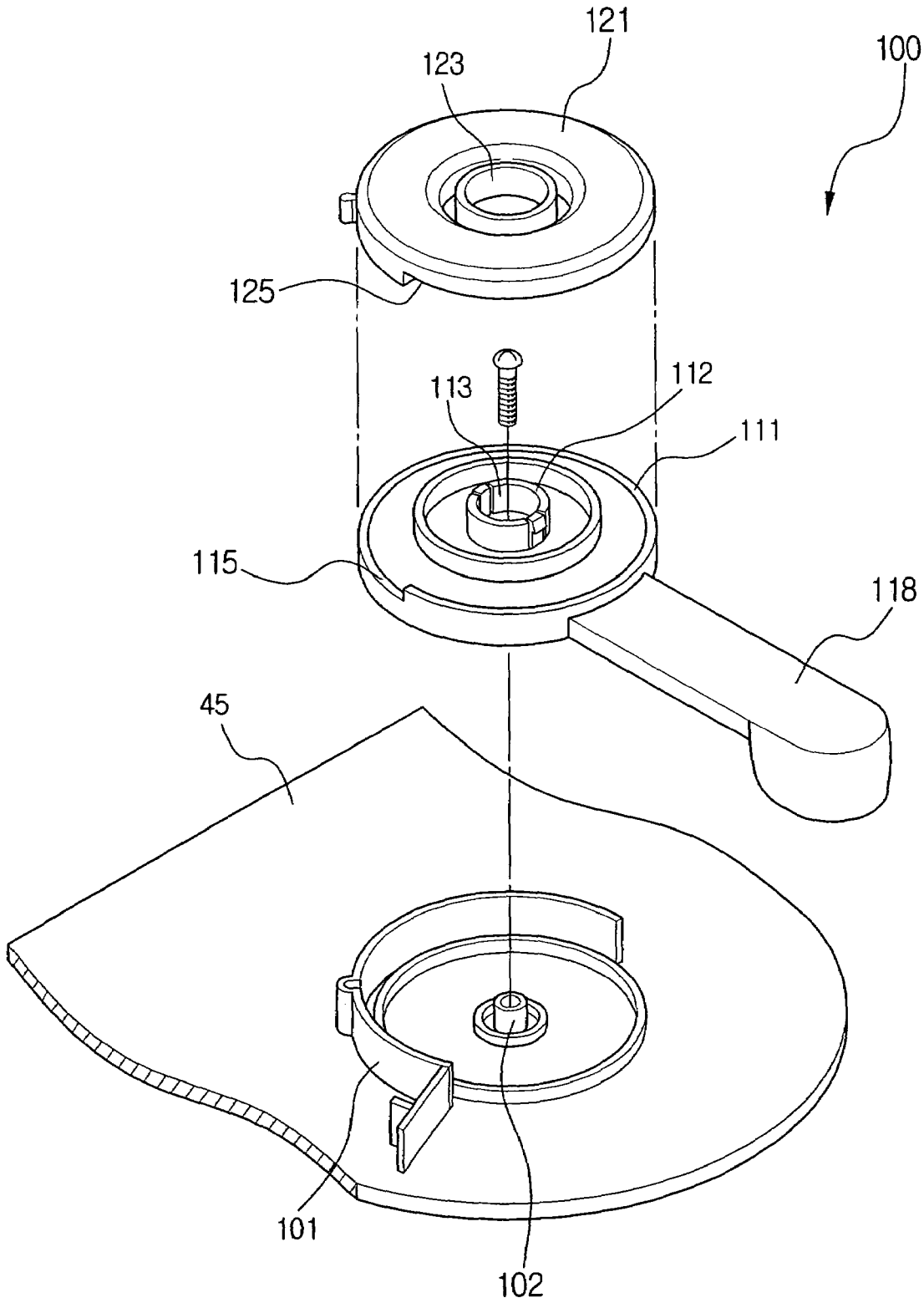
FIG. 2 (PRIOR ART)
FIG. 2 is a perspective view of the conventional cyclone type dust collecting apparatus.
Figure 3:
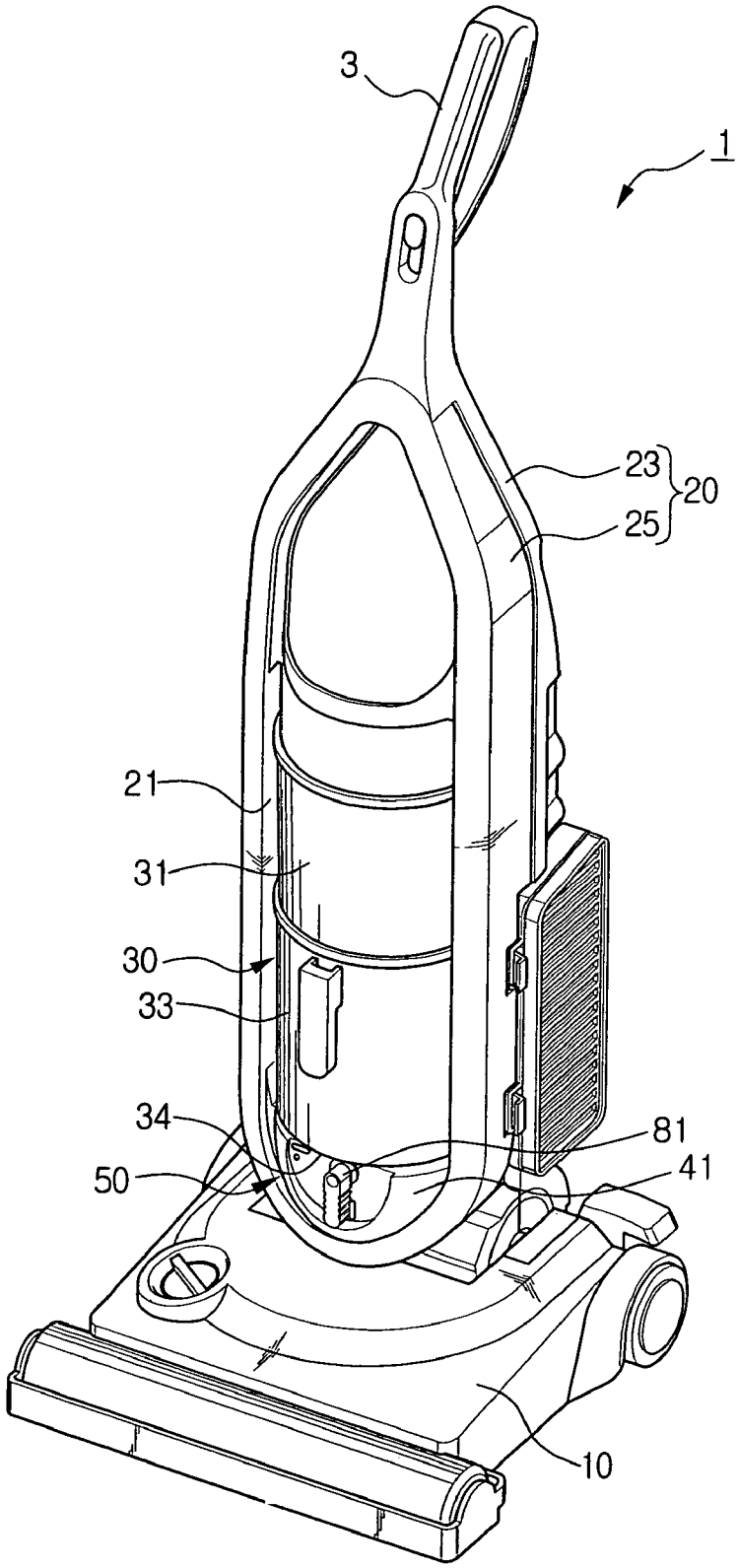
FIG. 3 is a perspective view of an upright type vacuum cleaner having a locking unit for a cyclone dust collector according to the present invention.
Figure 4:
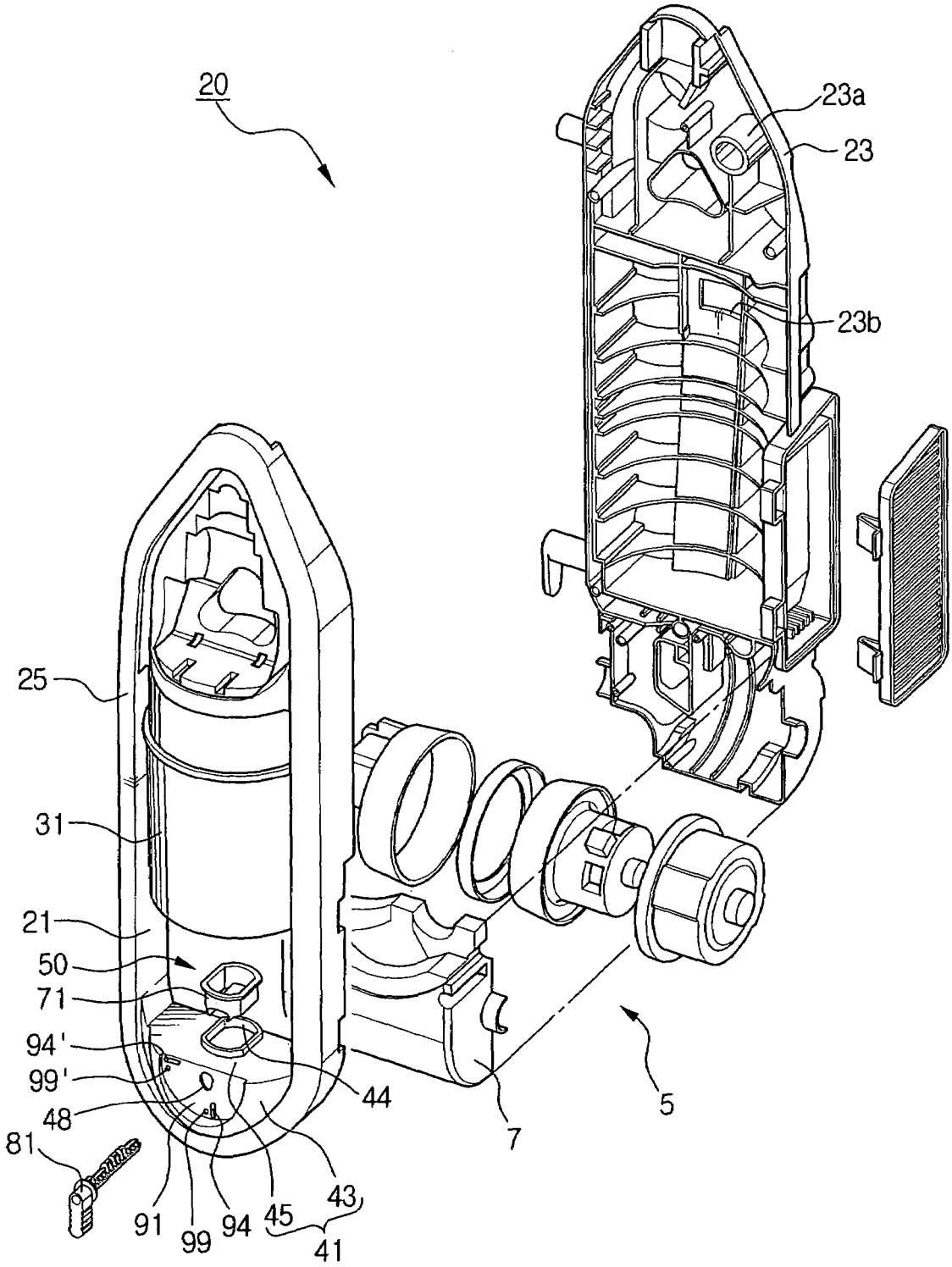
FIG. 4 is an exploded view of a main body of the vacuum cleaner of FIG. 3.

FIG. 3 is a perspective view of an upright type vacuum cleaner having a locking unit of a cyclone dust collector according to the present invention, and FIG. 4 is an exploded view of the upright type vacuum cleaner of FIG. 3. As shown in FIGS. 3 and 4, the upright type vacuum cleaner 1 comprises a main body 20 having an receiving portion 21 formed therein, a cyclone dust collector 30 removably mounted in the receiving portion 21, and a suction brush unit 10. The main body 20 has a handle 3 at an upper portion thereof.

The main body 20 comprises a body casing 23 and a front panel 25 coupled to a front side of the body casing 23. At a lower portion of the front panel 25 is mounted a vacuum generator 5, which is shielded by a cover 7. The front panel 25 has an opening at a center thereof to form the receiving portion 21. The front panel 25 has a manipulating unit 41 at a lower portion of the receiving portion 21, in which the locking unit 50 is disposed. The manipulating unit 41 is partitioned by a bottom plate 45 and a front plate 43 of the receiving portion 21.

The main body 20, which has the body casing 23 and the front panel 25, is usually provided with an inlet pipe 23*a* and an outlet duct 23*b*. The inlet pipe 23*a* interconnects a suction port of the cyclone dust collector 30 with the suction brush unit 10. The outlet duct 23*b* interconnects a discharge port of the cyclone dust collector 30 with the vacuum generator 5. When the vacuum generator 5 is driven, a suction force is applied to the suction brush unit 10, drawing in air containing dust and dirt into the inlet pipe. The drawn in air is directed into the cyclone dust collector 30 via the suction port, and the dust and dirt is centrifiually separated from the air and collected in the cyclone dust collector 30. As a result, clean air is discharged to the discharge port and outside through the outlet duct 23*b*.

To centrifugally separate dust and dirt from air, the cyclone dust collector 30 includes a cyclone body 31 and a dust receptacle 33 removably disposed at a lower portion of the cyclone body 31. The cyclone dust collector 30 is well-known technology and has been disclosed in many patent applications by various applicants including the present applicant. Accordingly, a detailed description of the cyclone dust collector 30 is omitted. However, according to the present invention, at a lower portion of the cyclone dust collector 30, i.e., at a bottom side of the dust receptacle 33, a locking recess 35 (see FIGS. 9 and 10) is formed. The locking recess 35 will be described in detail later together with a lock element 71.

Figure 5:
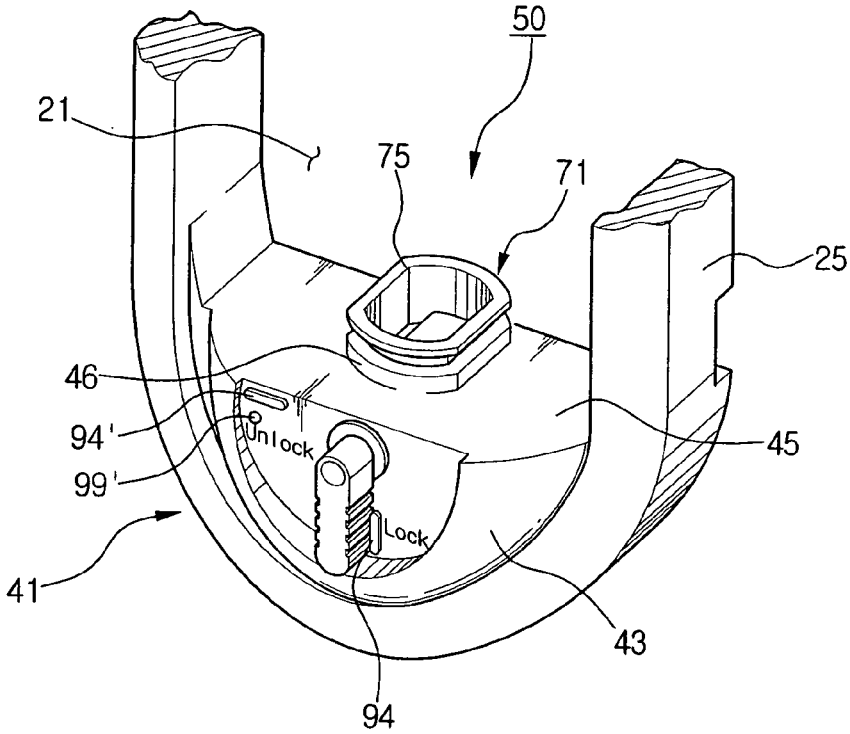
FIG. 5 is an enlarged assembly view of a main portion of FIG. 4, depicting a structure of the locking unit of the cyclone type dust collecting apparatus.
Figure 6:
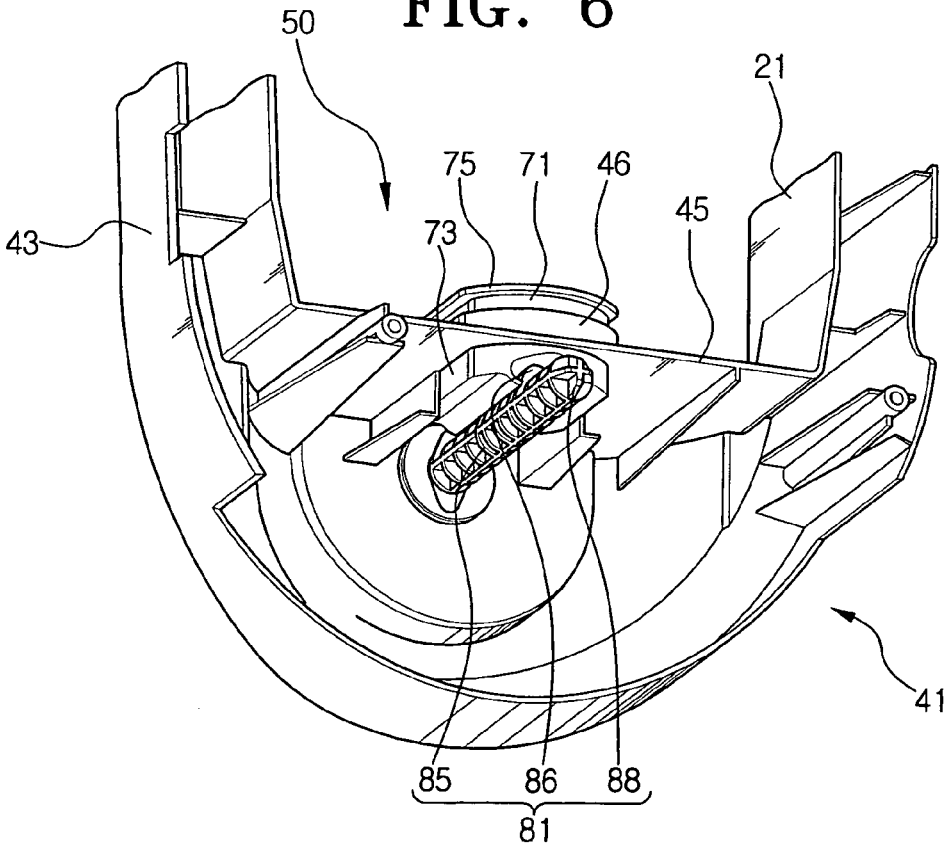
FIG. 6 is a rear view of FIG. 5.

FIG. 5 is an enlarged assembly view of a main portion of FIG. 4 in assembly, depicting the structure of a locking unit of the cyclone dust collector 30. FIG. 6 is a rear view of FIG. 5. As shown in FIGS. 5 and 6, the locking unit 50 comprises the lock element 71 disposed in the manipulating unit 41 to ascend and descend through the bottom plate 45 of the receiving portion 21, the locking recess 35 (FIG. 9) formed at a bottom 34 of the cyclone dust collector 30, and an operating member 81 to ascend the lock element 71 through the front side of the manipulating unit 41.

In the bottom plate 45 of the receiving portion 21, a lock element hole 44 (see FIG. 4) is formed for the ascent/descent of the lock element 71. The lock element 71 received in the lock element hole 44 is ascended to a locking position (see FIG. 10) and descended to an unlocking position (see FIG. 9). The lock element 71 is locked to and unlocked from the locking recess 35 of the bottom 34 of the cyclone dust collector 30. Extended portions 73, 75 are protruded outside the lock element 71 for limiting a range of ascending and descending movement of the lock element 71. The extended portion 75 (upper) is extended outward from an upper portion of the lock element 71, and the extended portion 73 (lower) is extended outward from both sides of the lock element 71. The extended portions 73, 75 are positioned at a regular distance from each other, and the bottom plate 45 of the receiving portion 21 is disposed between the extended portions 73 and 75. At the lock element hole 44 of the bottom plate 45, a rib 46 is projected upwardly to support the ascending and descending of the lock element 71.

Figure 7:
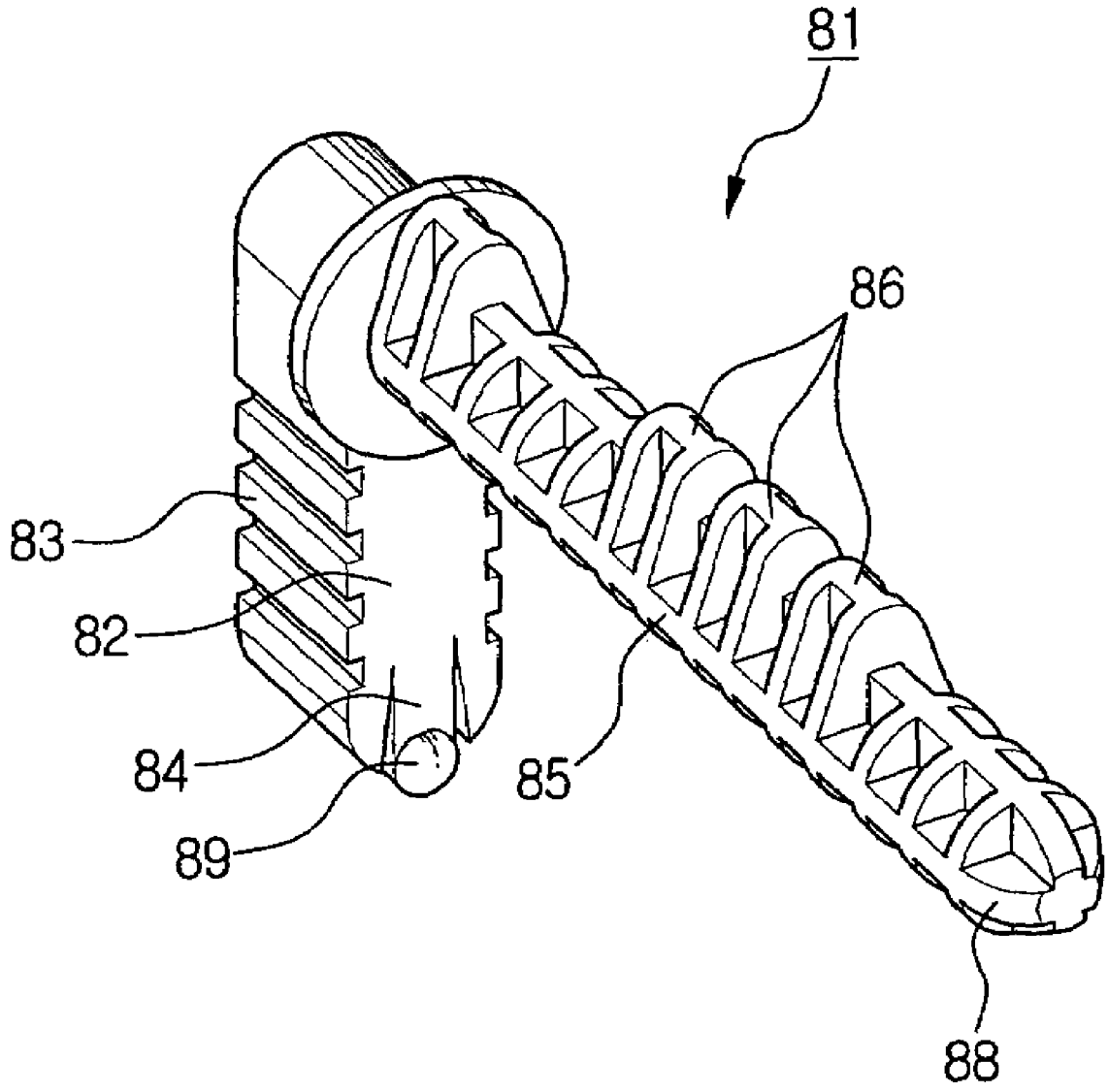
FIG. 7 is a partially enlarged view of a body casing of FIG. 4, depicting a supporting rib supporting an extended bar of an operating member.

The operating member 81, as shown in FIG. 7 in detail, comprises an extended bar 85 having a regular sectional radius, a grip 82 at one end of the extended bar 85 extending in a radial direction thereof, and a operating cam 86 formed at a center portion of the extended bar 85. The extended bar 85 passes through the front plate 43 of the manipulating unit 41 and is received therein. The front plate 43 has a through hole 48 to allow the passing of the extended bar 85. The through hole 48 is formed opposed to the extended bar 85 so as to allow the passing of the operating cam 86 which is integrally formed with the extended bar 85.

The grip 82 is rotatable and exposed on the front plate 43 of the manipulating unit 41. At both sides of the grip 82, knurls 83 are formed for an easy grip by a user. At an inner side of the grip 82, i.e., at a side opposing to the front plate 43 of the manipulating unit 41, a movable threshold 84 is projected. At a centerportion of the movable threshold 84 amovable projection 89 is projected. The movable threshold 84 and the movable projection 89 are connected with fixed limiting projections 94, 94' and fixed protuberances 99, 99' formed at the front plate 43 of the manipulating unit 41, which will be described later on.

Figure 9:
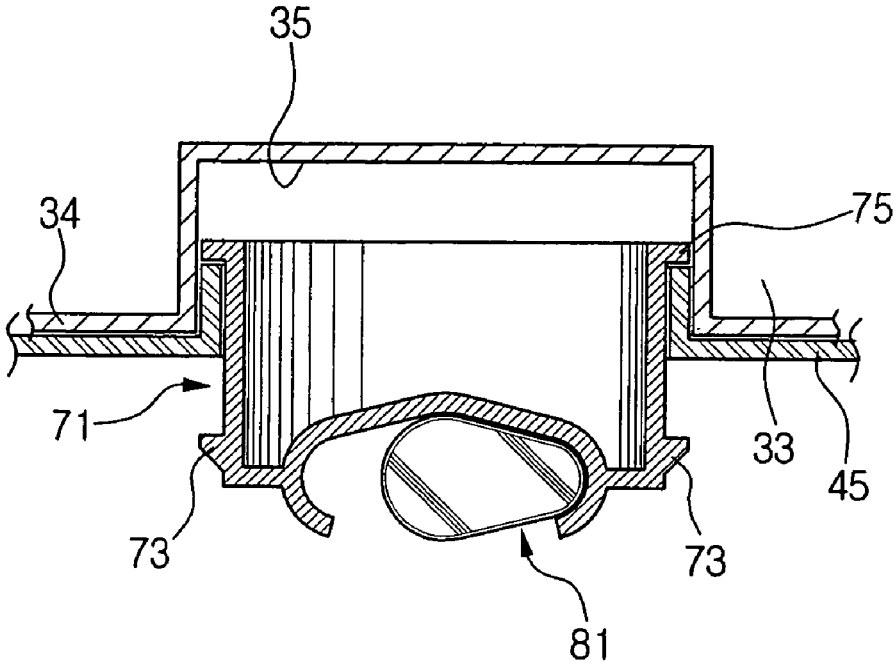
FIGS. 9 and 10 are enlarged sectional views of a main portion of FIG. 5, respectively, depicting ascending and descending of a lock element in a locking recess by the operating member.
Figure 10:
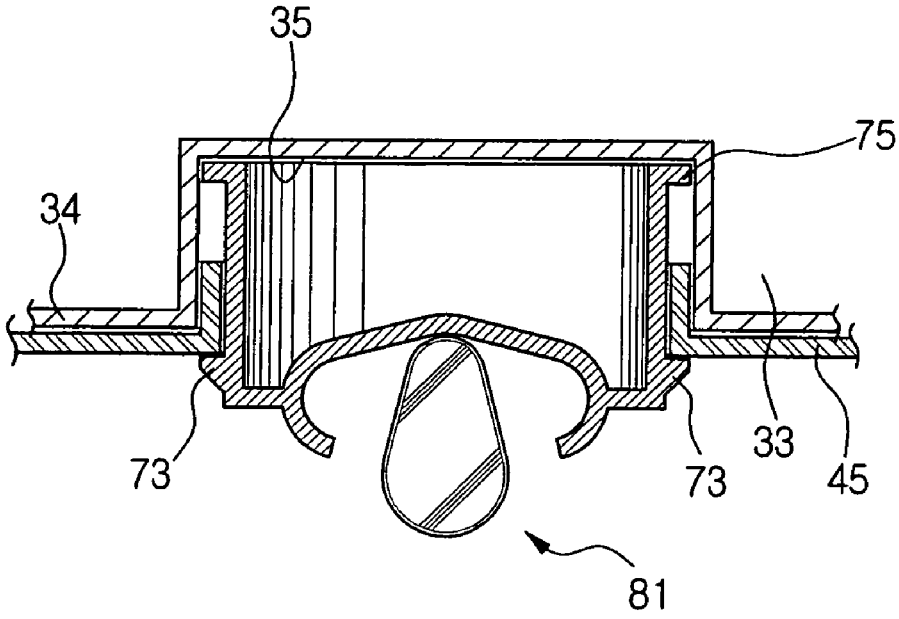

The operating cam 86 is extended from the extended bar 85 in an opposite direction to the extension direction of the grip 82 with respect to the extended bar 85. On turning the grip 82 to a horizontal plane, the operating cam 86 is subsequently disposed in a horizontal plane. The operating cam 86 in the horizontal plane, as shown in FIG. 9, allows the lock element 71 to descend, i.e., to the unlocking position. On tuning the grip 82 to a vertical plane, the operating cam 86 is subsequently rotated to a vertical direction. The operating cam 86 in the vertical plane, as shown in FIG. 10, causes the lock element 71 to ascend, i.e., to the locking position.

An indicator 91 is disposed at the front plate 43 of the manipulating unit 41 to indicate the position of the lock element 71. With respect to the indicator 91 includes a "LOCK" mark formed at the vertical position and an "UNLOCK" mark formed at the horizontal position (see FIG. 5). When the grip 82 is positioned at the "LOCK" mark, this means that the lock element 71 is at the locking position with respect to the locking recess 35 of the cyclone dust collector 30. When the grip 82 is positioned at the "UNLOCK" mark, this means that the lock element 71 is descended to the unlocking position.

The indicator 91 includes the fixed limiting projections 94,94' respectively protruded at the "LOCK" mark and the "UNLOCK" mark. The fixed limiting projections 94 and 94' in cooperation with the movable threshold 84 of the grip 82 prevent an excessive rotation of the grip 82. At an inner side of each fixed limiting projection 94,94', the fixed protuberances 99,99' are projected, respectively. Each of the fixed protuberances 99,99' is engaged with the movable projection 89 of the grip 82. Accordingly, the grip 82 of the operating member 81 is securely positioned at the "LOCK" mark or the "UNLOCK" mark on the indicator 91.

Figure 8:
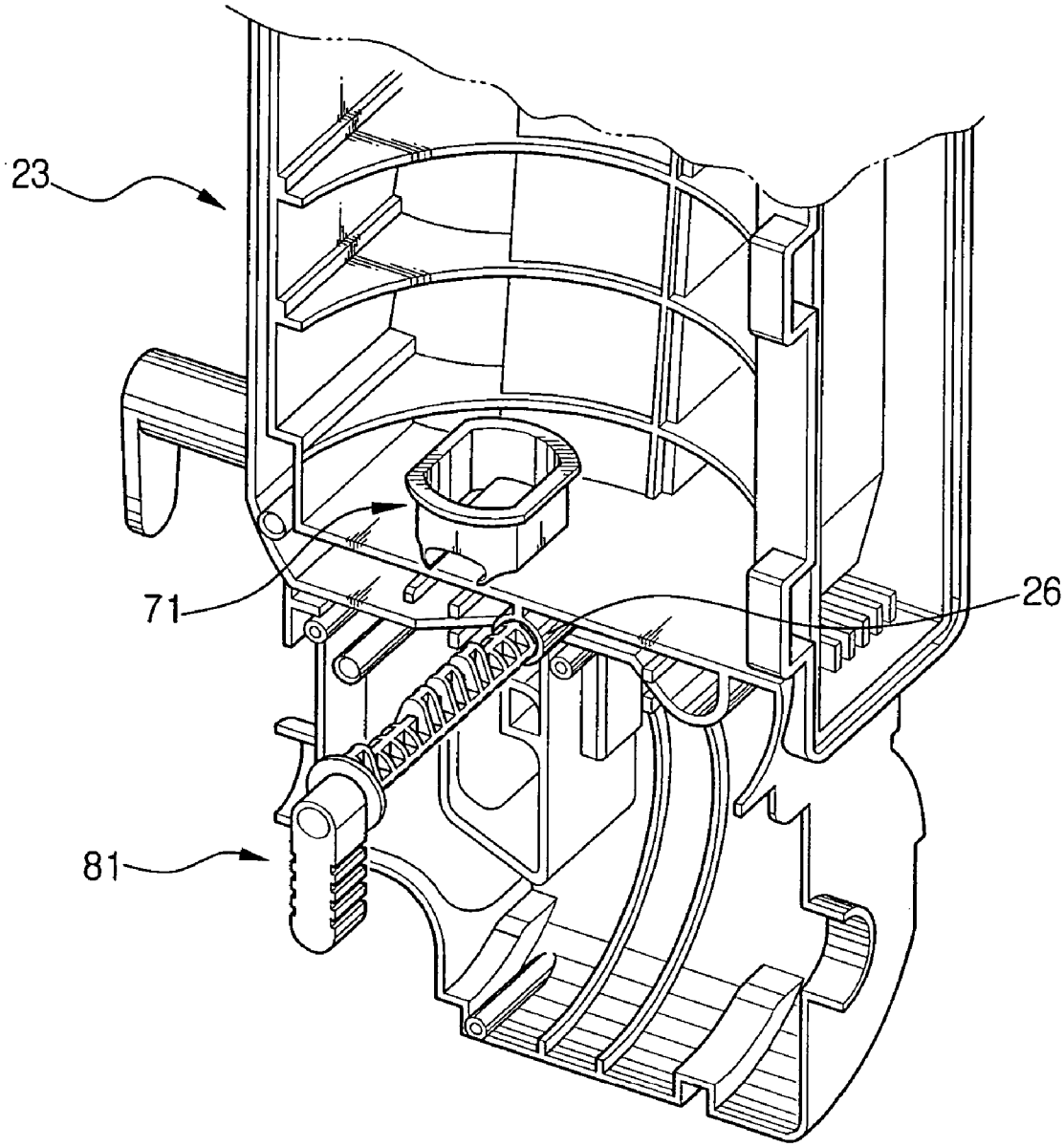
FIG. 8 is a perspective view depicting the operating member in detail.

A terminal end 88 of the operating member 81, which is passed through the front plate 43 of the manipulating unit 41 and received therein, is rotatably supported by a supporting rib 26. As shown in FIG. 8, the supporting rib 26 may preferably be disposed in the body casing 23.

The locking unit 50 having the above structure enables the user to manipulate the grip 82 of the operating member 81 with convenience, with the grip 82 exposed toward a front of the manipulating unit 41. In order to separate the cyclone dust collector 30 from the receiving portion 21, the user rotates the grip 82 to the "UNLOCK" mark. The grip 82 is secured at the "UNLOCK" mark by the engagement of the movable projection 89 with the fixed protuberance 99' of the indicator 91. The user separates the cyclone dust collector 30, removes the dust and dirt in the dust receptacle 33, and re-mounts the cyclone dust collector 30 in the receiving portion 21.

In order to fix the cyclone dust collector 30 in the receiving portion 21, the user rotates the grip 82 to the lock mark. With the grip 82 at the lock mark, the operating cam 86, eccentric to the extended bar 85, raises the lock element 71. At the locking position, the lock element 71 and the locking recess 35 of the dust receptacle 33 are engaged with each other to thereby securely fix the cyclone dust collector 30 in the receiving portion 21.

According to the above embodiment, in the main body 20 of the vacuum cleaner 1, the manipulating unit 41 at the lower portion of the front panel 25 includes the operating member 81 and the lock element 71, while the dust receptacle 33 of the cyclone dust collector 30 includes the locking recess 35. However, the aspects, features and advantages of the present invention will also be accomplished by variations such as the dust receptacle 35 having the operating member 81 and the lock element 71, and the manipulating unit 41 having the locking recess 35.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

What is claimed is:

1. A locking unit of a cyclone dust collector of a vacuum cleaner, which is removably received in a receiving portion of a main body of the vacuum cleaner, comprising:

a locking recess formed at one side of a contact surface of the cyclone dust collector and the receiving portion;

a lock element, ascending and descending between a locking position and an unlocking position with respect to the locking recess and passing through a hole which is formed at another side of the contact surface of the cyclone dust collector and the receiving portion; and an operating member to selectively move the lock element to the locking position and the unlocking position.

2. The locking unit of claim 1, wherein the locking recess is formed by depressing upwardly at a bottom side of the cyclone dust collector, and the lock element is received in a manipulating unit disposed at a lower portion of the receiving portion to move upward and downward through the hole at a bottom side of the receiving portion.

3. The locking unit of claim 2, wherein the operating member comprises:

a grip rotatably exposed toward a front side of the manipulating unit;

a bar extending from the grip toward the lock element passing through the front side of the manipulating unit; and an operating cam formed eccentrically on a free end of the bar, the operating cam rotating together with the grip to move the lock element upward and downward.

4. The locking unit of claim 3, wherein, in the main body of the vacuum cleaner a supporting rib is formed to rotatably support a terminal end of the extended bar.

5. The locking unit of claim 3, wherein, an indicator at the front side of the manipulating unit is disposed to indicate locking and unlocking of the lock element with respect to the locking recess.

6. The locking unit of claim 5, wherein the indicator includes means to securely fix the grip of the operating member in at least one of the locking position and the unlocking position.

7. The locking unit of claim 6, wherein the indicator includes a pair of limiting projections disposed at regular intervals within a rotating range of the grip to prevent excessive rotation of the grip.

8. The locking unit of claim 3, wherein the main body of the vacuum cleaner comprises:

a body casing; and a front panel coupled to a front side of the body casing to form a receiving portion, which includes the manipulating unit at a lower portion thereof.

* * * * *